US007809301B2

(12) United States Patent
Koakutsu

(10) Patent No.: US 7,809,301 B2
(45) Date of Patent: Oct. 5, 2010

(54) IMAGE PROCESSING APPARATUS SELECTIVELY OPERABLE DURING A DISASTER, AND METHOD FOR PERFORMING THE SAME

(75) Inventor: Masafumi Koakutsu, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 188 days.

(21) Appl. No.: 11/858,666

(22) Filed: Sep. 20, 2007

(65) Prior Publication Data

US 2008/0205909 A1 Aug. 28, 2008

(30) Foreign Application Priority Data

Feb. 22, 2007 (JP) ..... 2007-041627

(51) Int. Cl.
*G03G 15/00* (2006.01)

(52) U.S. Cl. ..... 399/82

(58) Field of Classification Search ..... 399/18–21, 399/37, 82

See application file for complete search history.

(56) References Cited

U.S. PATENT DOCUMENTS 5,923,919 A * 7/1999 Nimura et al. ..... 399/37
7,280,771 B2 * 10/2007 Mandel et al. ..... 399/9
2004/0037574 A1 * 2/2004 Yamamuro et al. ..... 399/13
2004/0156056 A1 * 8/2004 Sawada ..... 358/1.2
2007/0136613 A1 * 6/2007 Chen ..... 713/300

FOREIGN PATENT DOCUMENTS

| | | |
|---|---|---|
| JP | 08-272178 | 10/1996 |
| JP | 10-143029 | 5/1998 |
| JP | 11-184327 | 7/1999 |
| JP | 2001-023060 | 1/2001 |
| JP | 2003248398 A * | 9/2003 |
| JP | 2005-231131 | 9/2005 |
| JP | 2007-007980 | 1/2007 |

OTHER PUBLICATIONS http://media.merriam-webster.com/dictionary/disaster.*

* cited by examiner

*Primary Examiner*—David M Gray
*Assistant Examiner*—Barnabas T Fekete
(74) *Attorney, Agent, or Firm*—Sughrue Mion, PLLC

(57) ABSTRACT

The image processing apparatus includes an acquiring unit that acquires information on disaster; and a switching unit that switches an operational mode of the image processing apparatus from a first operational mode in which image processing is not performed when there is lack of a part of consumables or failure of a part of functions to a second operational mode in which the image processing is performed by using other consumables that are available and other functions that do not fail even when there is the lack of a part of consumables or the failure of a part of functions, in response to the information on disaster acquired by the acquiring unit.

15 Claims, 16 Drawing Sheets

FIG.2

<SITE OF IMAGE PROCESSING APPARATUS>

XX TOWN, XX CITY, XX PREFECTURE

<DISASTER TYPE>

EARTHQUAKE

<SEISMIC INTENSITY>

7

<SEISMIC CENTER>

ZZ TOWN, ZZ CITY, ZZ PREFECTURE

<MAGNITUDE>

MAGNITUDE OF 6.9

<INFORMATION ON NEIGHBORING AREAS TO IMAGE PROCESSING APPARATUS>

YY TOWN, YY CITY, XX PREFECTURE

RESCUE REQUIRED

FIG.3

EARTH QUAKE DISASTER | WIND AND FLOOD DISASTER | VOLCANIC DISASTER | NUCLEAR POWER DISASTER | SNOW DISASTER | ACCIDENTAL DISASTER | OTHER DISASTERS

| | DISASTER LEVEL LV1 | DISASTER LEVEL LV2 | DISASTER LEVEL LV3 |
|---|---|---|---|
| SEISMIC INTENSITY OF APPARATUS | INTENSITY UP TO 5 LOWER | INTENSITY 5 UPPER TO 7 | INTENSITY 8 OR MORE |
| DISTANCE FROM APPARATUS TO SEISMIC CENTER | MORE THAN FIFTY KILOMETERS | FIFTY KILOMETERS OR LESS AND TWENTY KILOMETERS OR MORE | LESS THAN TWENTY KILOMETERS |
| MAGNITUDE | 4.0 OR LESS | 4.1 OR MORE AND 7.0 OR LESS | 7.1 OR MORE |
| INFORMATION ON NEIGHBORING AREAS | | RESCUE REQUIRED | UNABLE TO CONTACT |
| ELAPSED TIME | ONE WEEK OR MORE | FOUR DAYS OR LESS | TWO DAYS OR LESS |
| ... | | | |

FIG.7A

| LEVEL \ DISASTER TYPE | EARTH QUAKE | WIND AND FLOOD | VOLCANO | NUCLEAR POWER | SNOW | ACCIDENT | OTHERS |
|---|---|---|---|---|---|---|---|
| DISASTER LEVEL LV1 | NORMAL MODE | NORMAL MODE | NORMAL MODE | NORMAL MODE | NORMAL MODE | NORMAL MODE | NORMAL MODE |
| DISASTER LEVEL LV2 | CONTINUOUS MODE (ULV1) | CONTINUOUS MODE (ULV1) | NORMAL MODE | NORMAL MODE | NORMAL MODE | NORMAL MODE | NORMAL MODE |
| DISASTER LEVEL LV3 | CONTINUOUS MODE (ULV2) | CONTINUOUS MODE (ULV2) | CONTINUOUS MODE (ULV1) | NORMAL MODE | CONTINUOUS MODE (ULV1) | CONTINUOUS MODE (ULV1) | CONTINUOUS MODE (ULV1) |

FIG.7B

| DISASTER TYPE / LEVEL | EARTH QUAKE | WIND AND FLOOD | VOLCANO | NUCLEAR POWER | SNOW | ACCIDENT | OTHERS |
|---|---|---|---|---|---|---|---|
| DISASTER LEVEL LV1 | NORMAL MODE | NORMAL MODE | NORMAL MODE | NORMAL MODE | NORMAL MODE | NORMAL MODE | NORMAL MODE |
| DISASTER LEVEL LV2 | CONTINUOUS MODE (ULV1) | CONTINUOUS MODE (ULV1) | NORMAL MODE | CONTINUOUS MODE (ULV1) | NORMAL MODE | NORMAL MODE | NORMAL MODE |
| DISASTER LEVEL LV3 | CONTINUOUS MODE (ULV2) | CONTINUOUS MODE (ULV2) | NORMAL MODE | CONTINUOUS MODE (ULV2) | NORMAL MODE | CONTINUOUS MODE (ULV1) | CONTINUOUS MODE (ULV1) |

FIG.11

| BLACK | CYAN | MAGENTA | YELLOW | USED TONER | COLOR OF OUTPUTTING |
|---|---|---|---|---|---|
| TONER REMAINING | LACK OF ONE OR MORE TONERS AMONG CYAN TONER, MAGENTA TONER, AND YELLOW TONER | | | BLACK | BLACK |
| NO TONER | TONER REMAINING | TONER REMAINING | TONER REMAINING | CYAN, MAGENTA, YELLOW | PROCESS BLACK MADE FROM MIX OF CYAN, MAGENTA, AND YELLOW |
| NO TONER | TONER REMAINING | TONER REMAINING | NO TONER | CYAN, MAGENTA | BLUE |
| NO TONER | TONER REMAINING | NO TONER | TONER REMAINING | CYAN, YELLOW | GREEN |
| NO TONER | TONER REMAINING | NO TONER | NO TONER | CYAN | CYAN |
| NO TONER | NO TONER | TONER REMAINING | TONER REMAINING | MAGENTA, YELLOW | RED |
| NO TONER | NO TONER | TONER REMAINING | NO TONER | MAGENTA | MAGENTA |
| NO TONER | NO TONER | NO TONER | TONER REMAINING | – | – |

FIG.13

INFLUENCE DETERMINATION TABLE REGARDING SCANNER USE

| TYPES OF ERROR | DOES ERROR INFLUENCE USE OF SCANNER ? |
|---|---|
| CRU NON-MOUNTING ERROR | NO |
| DOOR OPEN ERROR | NO |
| PAPER JAM | NO |
| FIXING UNIT ERROR | NO |
| SCANNER MOTOR ERROR | YES |
| HARD DISC ERROR | YES |
| ... | ... |

IMAGE PROCESSING APPARATUS SELECTIVELY OPERABLE DURING A DISASTER, AND METHOD FOR PERFORMING THE SAME

CROSS-REFERENCE TO RELATED APPLICATION

This application is based on and claims priority under 35 USC §119 from Japanese Patent Application No. 2007-41627 filed Feb. 22, 2007.

BACKGROUND

1. Technical Field

The present invention relates to an image processing apparatus, an image processing method and a computer readable medium storing a program causing a computer to execute a process for image processing.

2. Related Art

Recently, it is strongly argued that there is a need for risk management against disasters. As disasters, for example, there are catastrophic disasters such as a fire, climatic disasters (torrential rainfall, lightning, snow and the like), an earthquake, a volcanic eruption, a tsunami, a typhoon, terrorism and industrial accidents. For example, for various apparatuses such as an image processing apparatus that processes an image to be outputted to a recording medium, measures in the time of disaster have been conventionally made.

SUMMARY

According to an aspect of the invention, there is provided an image processing apparatus including an acquiring unit that acquires information on disaster; and a switching unit that switches an operational mode of the image processing apparatus from a first operational mode in which image processing is not performed when there is lack of a part of consumables or failure of a part of functions to a second operational mode in which the image processing is performed by using other consumables that are available and other functions that do not fail even when there is the lack of a part of consumables or the failure of a part of functions, in response to the information on disaster acquired by the acquiring unit.

BRIEF DESCRIPTION OF THE DRAWINGS

Exemplary embodiment (s) of the present invention will be described in detail based on the following figures, wherein:

FIG. 2 is a diagram illustrating an example of the disaster information acquired by the disaster information acquiring unit and used for the switching process of the mode switching unit;

FIG. 3 is a diagram illustrating an example of a level determination table stored in the distinctive information storage unit;

FIG. 7A is a table illustrating an example of memory information (for example, matching tables) for selecting the mode corresponding to the disaster type and the disaster level (disaster stage);

FIG. 7B is a table illustrating an example of memory information (for example, matching tables) for selecting the mode corresponding to the disaster type and the disaster level (disaster stage);

FIG. 11 is a table that is referred to in the process for print output;

FIG. 13 is an influence determination table regarding scanner use;

DETAILED DESCRIPTION

Hereinafter, exemplary embodiments of the present invention will be described in detail with reference to the drawings.

Figure 1:
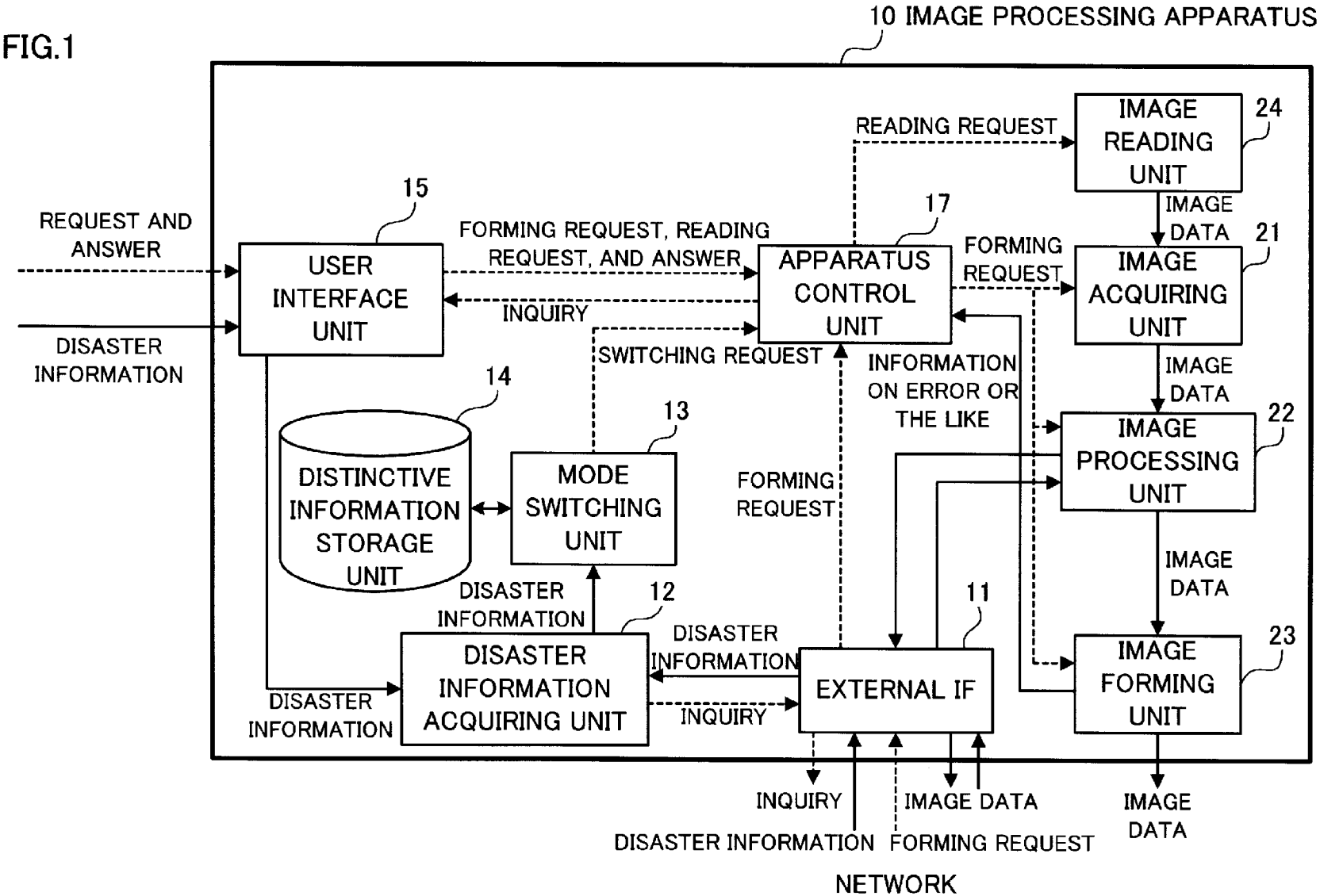
FIG. 1 is a functional block diagram illustrating an example of a configuration of an image processing apparatus to which the exemplary embodiment is applied.

FIG. 1 is a functional block diagram illustrating an example of a configuration of an image processing apparatus 10 to which the exemplary embodiment is applied. The image processing apparatus 10 is realized by a computer apparatus such as an embedded computer integrated with an image forming apparatus having a function as a printer, a facsimile, a copying machine or the like, a computer apparatus such as a personal computer connected externally to the image forming apparatus, a computer apparatus such as an embedded computer integrated with an image input apparatus having a function as a scanner or the like, or a computer apparatus such as a personal computer connected externally with the image input apparatus. The image processing apparatus 10 is, for example, installed in a retail shop that deals with a variety of products in a small space, that is, a so-called convenience store or the like. The image processing apparatus 10 installed in the so-called convenience store or the like may be utilized as, for example, a printer, a facsimile, a copying machine, a scanner, and an apparatus that prints out pictures taken by a digital camera or the like in a normal operational state.

Moreover, the image processing apparatus 10 is provided with an external IF (interface) 11 that executes communication with the outside, for example, acquiring various kinds of information from a server. The external IF 11 is, for example, connected to a company network, the internet and a server through exclusive lines, a VPN (virtual private network) or the like. In addition, the image processing apparatus 10 is provided with a disaster information acquiring unit 12 that acquires disaster information (information on disaster), and a mode switching unit 13 that switches an operational mode of the image processing apparatus 10 on the basis of the disaster information acquired from the disaster information acquiring unit 12. Further, the image processing apparatus 10 is provided with a distinctive information storage unit 14 that is a memory storing various kinds of information when disaster type determination, disaster level (disaster stage) determination or the like described later is performed.

Moreover, the image processing apparatus 10 is provided with a user interface unit (UI unit) 15 that accepts user operation by a position indicating apparatus such as a mouse and a touch panel, or an input apparatus such as a keyboard, and that identifies an instruction related to image processing on the basis of the accepted user operation. The UI unit 15 may be disposed in the image processing apparatus 10, and provided by being connected to an information processing apparatus such as a cellular phone, a PDA (personal digital assistance), an electronic data book, a personal computer or the like by wired or wireless connection. Depending on circumstances, by using various input functions, information inputted from a user such as the disaster information is recognized.

Moreover, the image processing apparatus 10 is provided with an apparatus control unit 17 that controls the whole image processing apparatus 10. Furthermore, as various functions relating to the image processing, for example, the image processing apparatus 10 is provided with an image acquiring unit 21 that acquires image data to be processed from a computer such as a scanner, a telephone line, a computer such as a PC (personal computer) connected externally or the like, an image processing unit 22 that processes the image data acquired, an image forming unit 23 that outputs the image data processed, and an image reading unit 24 that reads an image from an original copy. Here, the image forming unit 23 may preferably include an image forming apparatus that uses, for example, an image forming method forming a toner image on a sheet of paper by electrophotography, or an ink jet method forming an image by spraying ink onto a sheet of paper. Moreover, the image forming unit 23 may be configured as such that it does not actually execute the image forming on a sheet of paper, but outputs the image data to an image forming apparatus connected through a predetermined line. Further, the image reading unit 24 may preferably include a scanner that uses a CCD (Charge Coupled Devices) method, a CIS (Contact Image Sensor) method or the like, for example.

The image processing apparatus 10 shown in FIG. 1 has several aspects in acquiring the information on disaster.

First aspect shows that the disaster information acquiring unit 12 acquires the information on disaster from the UI unit 15. For example, the UI unit 15 of the image processing apparatus 10 may be provided with a function for inputting an emergency state and recognizes the input thereby so as to acquire the information on disaster. The input of emergency state is performed by using an emergency button (switch), setting emergency command and the like. When the disaster information is acquired by the disaster information acquiring unit 12, the mode switching unit 13 switches the operational mode of the image processing apparatus 10 from a normal operational mode to a disaster operational mode, on the basis of the acquired disaster information.

Second aspect shows that the disaster information acquiring unit 12 has a function as a disaster recognizing unit, which autonomously determines the information on disaster (disaster information). For example, the disaster information acquiring unit 12 is provided with an earthquake observation instrument, a vibration detection function or the like so as to recognize the disaster by itself. As an example of using the earthquake observation instrument, a method that detects an initial tremor of the earthquake (P wave: primary wave) and further detects the magnitude and the location of the earthquake in order to recognize an effect of the earthquake on the image processing apparatus 10 is considered. As well as the first aspect, the mode switching unit 13 performs a process of switching the operational mode of the image processing apparatus 10 from the normal operational mode to the disaster operational mode.

Third aspect shows that the information on disaster (disaster information) is received through a network. For example, by the external IF (interface) 11, the information on disaster is acquired from a server computer through the internet that is a network using TCP/IP communication protocol. The information on disaster through the network includes, for example, information provided by government agencies and local governments, information provided by external organizations such as business enterprises and the like. As well as the first and second aspects, the mode switching unit 13 performs the process of switching the operational mode of the image processing apparatus 10 from the normal operational mode to the disaster operational mode.

Fourth aspect shows that the information on disaster is acquired by inquiring a server through the network, namely, a pull method (a method that expected contents are pulled by the user). In the fourth aspect, the disaster information acquiring unit 12 outputs inquiry information to the external IF 11, and the external IF 11 accesses an external server computer through, for example, the internet on the basis of the inquiry information so that the external IF 11 acquires the information on disaster. As well as the first to third aspects, the mode switching unit 13 performs the process of switching the operational mode of the image processing apparatus 10 from the normal operational mode to the disaster operational mode.

FIG. 2 is a diagram illustrating an example of the disaster information acquired by the disaster information acquiring unit 12 and used for the switching process of the mode switching unit 13. The information on disaster (disaster information) is, for example, created as a XML file. In the example shown in FIG. 2, the disaster information includes various kinds of information used for the disaster level determination such as a site of the image processing apparatus 10, a disaster type, seismic intensity, the seismic center, the magnitude measured on the Richter scale, and information on neighboring areas to the image processing apparatus 10. As the "disaster type", an example of "earthquake" is shown in FIG. 2. According to the types of the disaster level (disaster stage), each of the items in the file such as the seismic intensity, the seismic center, the magnitude and the like is determined (described later).

Next, a description will be given to the distinctive information storage unit 14. The distinctive information storage unit 14 is configured as a storage medium such as a hard disc drive (HDD) in which reading and writing information is performed by the mode switching unit 13 having a function of software executed by a CPU (described later).

FIG. 3 is a diagram illustrating an example of a level determination table stored in the distinctive information storage unit 14. The level determination table is read by the CPU executing a processing program, and temporarily stored, for example, in a working memory (described later) for processing of the CPU. As shown in FIG. 3, in the level determination table, evaluation items (determination items) and degrees thereof are given for each of the disaster types so that the disaster level (disaster stage) is to be determined. The disaster types include earthquake disaster, wind and flood disaster, volcanic disaster, nuclear power disaster, snow disaster, accidental disaster and other disasters. In FIG. 3, the earthquake disaster is selected.

In FIG. 3, as the evaluation items for the earthquake disaster, the seismic intensity of the image processing apparatus 10, distance from the image processing apparatus 10 to the seismic center, the magnitude, the information on neighboring areas, and elapsed time are listed. As the disaster level to be determined, in FIG. 3, a disaster level LV1 that is a first disaster level, a disaster level LV2 that is a second disaster level, and a disaster level LV3 that is a third disaster level are shown. With regard to the seismic intensity of the image processing apparatus 10 that is one of the evaluation items, as reference values, for example, the seismic intensity of up to 5 lower is to be the disaster level LV1, the seismic intensity 5 upper to 7 is to be the disaster level LV2, and the seismic intensity 8 or more is to be the disaster level LV3. As a scale of the seismic intensity, the Japan Meteorological Agency Seismic Intensity Scale is used here.

Similarly, with regard to the distance from the image processing apparatus 10 to the seismic center, as reference values, for example, the distance of more than fifty kilometers is to be the disaster level LV1, the distance of fifty kilometers or less and twenty kilometers or more is to be the disaster level LV2, and the distance of less than twenty kilometers is to be the disaster level LV3. Moreover, with regard to the magnitude, as reference values, for example, the magnitude of 4.0 or less is to be the disaster level LV1, the magnitude of 4.1 or more and 7.0 or less is to be the disaster level LV2, and the magnitude of 7.1 or more is to be the disaster level LV3.

Moreover, with regard to the information on neighboring areas, for example, "rescue required" is to be the disaster level LV2, and "unable to contact" is to be the disaster level LV3. Further, with regard to the elapsed time, as reference values, for example, one week or more is to be the disaster level LV1, four days or less is to be the disaster level LV2, and two days or less is to be the disaster level LV3. The mode switching unit 13 reads the level determination table as shown in FIG. 3 from the HDD, sets the table in the memory, and matches the table with the disaster information as shown in FIG. 2 for example. By the matching, one of the disaster levels LV1 to LV3 is determined and the disaster level is set in the memory.

As described above, on the basis of matching the disaster information that has been acquired to the level determination table given for each of the disaster types, the disaster level that is guidance for determining the operational mode is determined. In the level determination table, the reference values corresponding to the disaster level are given for each of the evaluation items. By observing matching the disaster information to the level determination table, a preferable disaster level is obtained for each of the evaluation items. The disaster level may be determined by using, for example, the highest level among the evaluation items of the disaster information. The disaster level may also be determined by using, for example, the average level.

Next, a description will be given to a process executed by the image processing apparatus 10 shown in FIG. 1 by using a flowchart.

Figure 4:
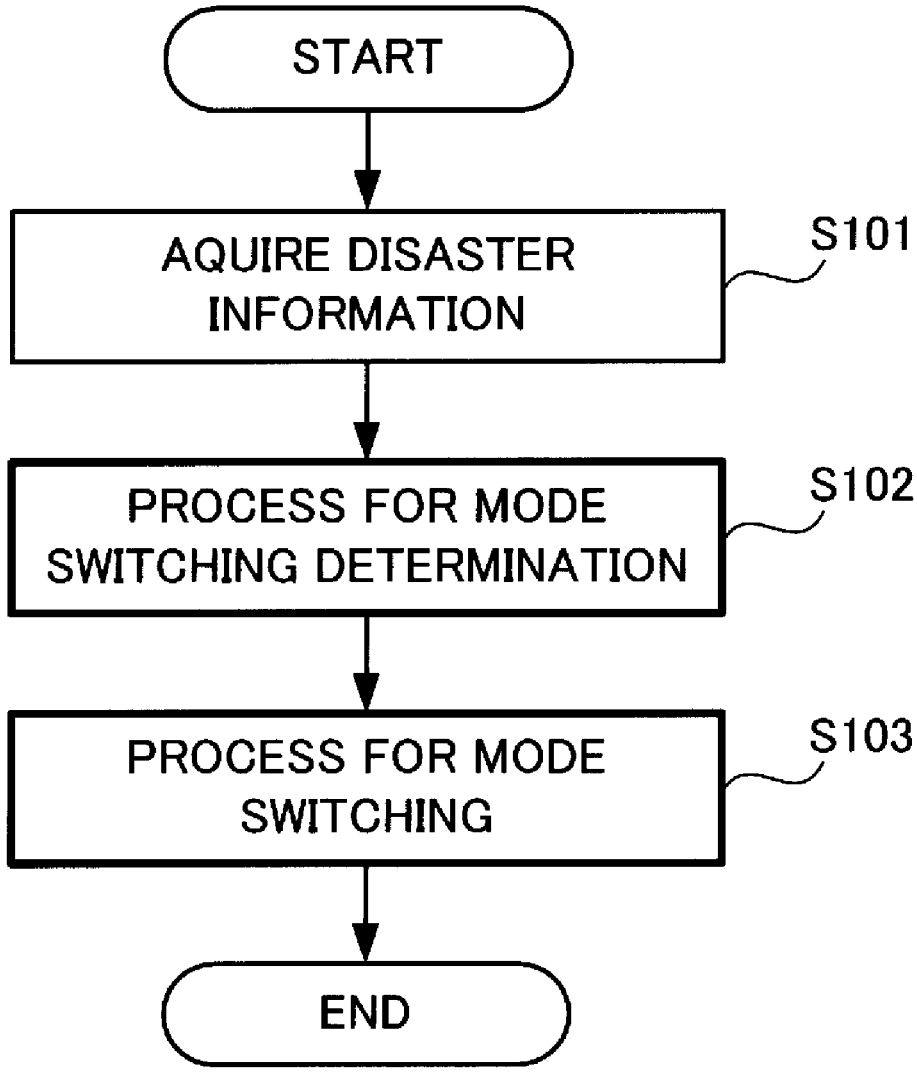
FIG. 4 is a flowchart illustrating an entire process executed by the image processing apparatus.

FIG. 4 is a flowchart illustrating an entire process executed by the image processing apparatus 10. The disaster information acquiring unit 12 of the image processing apparatus 10 acquires the disaster information by a predetermined method (step 101). In the predetermined method, in the first aspect described above, the information on disaster is acquired from the UI unit 15. In the first aspect, for example, when a user inputs a predetermined input data on disaster occurrence from the UI unit 15, the UI unit 15 outputs, for example, a predetermined command to the disaster information acquiring unit 12. The disaster information acquiring unit 12 determines the disaster type, the disaster level or the like from the command, and outputs the disaster information as shown in FIG. 2 to the mode switching unit 13 as a determinable content for the mode switching unit 13.

Moreover, in step 101, in the case of the second aspect described above, the disaster information acquiring unit 12 autonomously determines a situation and acquires the information on disaster (disaster information). The disaster information acquiring unit 12 outputs the disaster information as shown in FIG. 2 to the mode switching unit 13 as a determinable content for the mode switching unit 13.

In the case of the third aspect described above, the information on disaster (disaster information) is received by the external IF (interface) 11 through the network. Thereafter, the disaster information acquiring unit 12 converts the information on disaster received into the disaster information as shown in FIG. 2, and outputs the information to the mode switching unit 13 as a determinable content for the mode switching unit 13.

Further, in the fourth aspect described above, the disaster information acquiring unit 12 outputs the inquiry information to the external IF (interface) 11. The external IF (interface) 11 outputs the inquiry information to the server computer through the network. The disaster information acquiring unit 12 acquires the information on disaster (disaster information) through the external IF (interface) 11 as a response to the inquiry. Thereafter, the disaster information acquiring unit 12 converts the information on disaster acquired into the disaster information as shown in FIG. 2, and outputs the converted disaster information to the mode switching unit 13.

Next, the mode switching unit 13 that acquires the disaster information from the disaster information acquiring unit 12 in step 101 executes a predetermined process for mode switching determination to be described later (step 102). Thereafter, the apparatus control unit 17 that acquires information on switching request from the mode switching unit 13 executes the process for mode switching to be described later (step 103), and the processing is finished.

Figure 5:
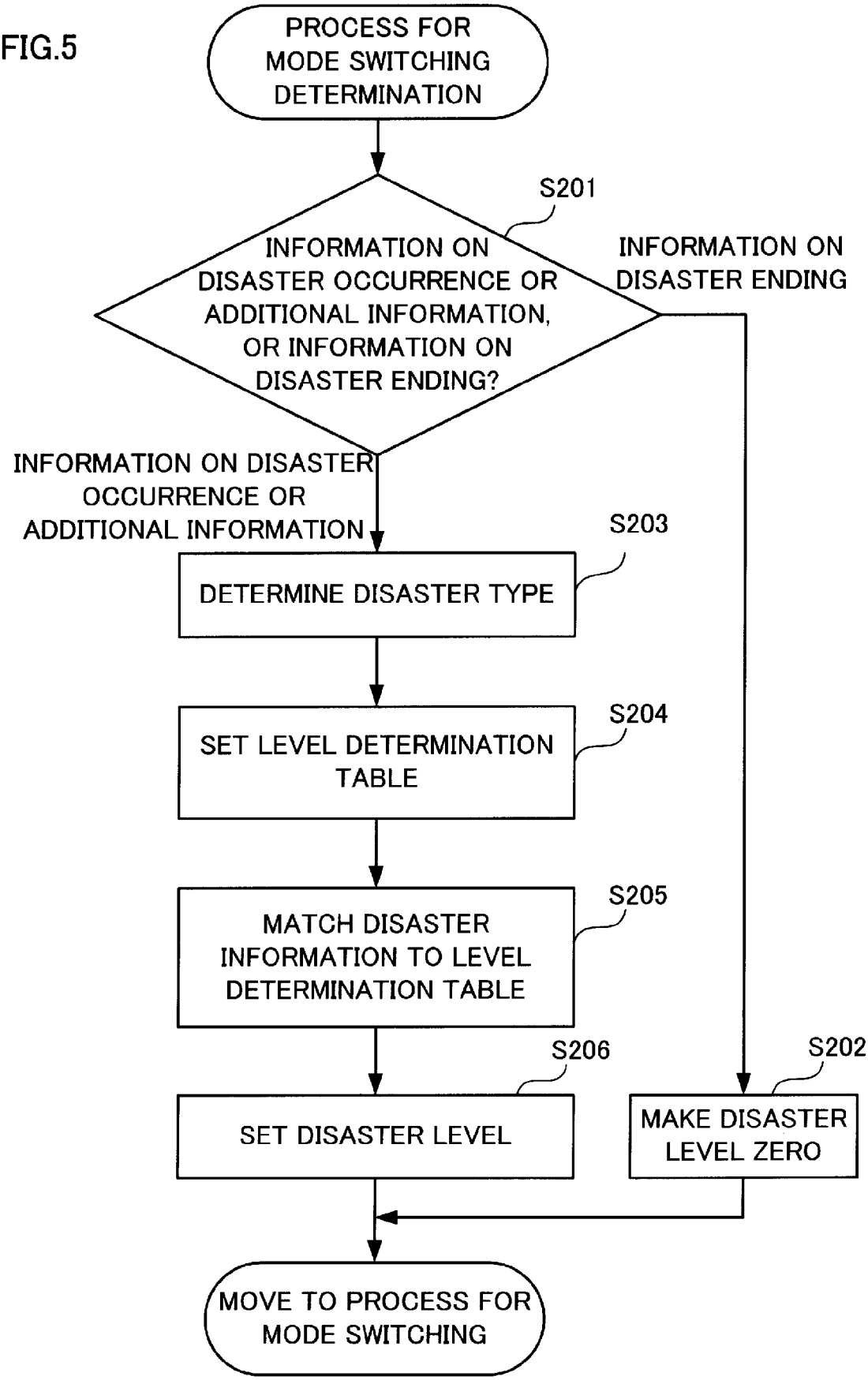
FIG. 5 is a flowchart illustrating in detail the process for mode switching determination.

FIG. 5 is a flowchart illustrating in detail the process for mode switching determination shown in step 102 in FIG. 4. First, the mode switching unit 13 of the image processing apparatus 10 determines whether the disaster information acquired by the disaster information acquiring unit 12 is information on disaster occurrence or additional information, or information on disaster ending (step 201). When the disaster information is determined to be the information on disaster ending, the disaster level is rated as zero (step 202) and the processing moves to the mode switching process shown in step 103 in FIG. 4.

When the mode switching unit 13 determines that the disaster information is the information on disaster occurrence or additional information in step 201, the mode switching unit 13 then determines the disaster type (step 203). The mode switching unit 13 reads the level determination table (see FIG. 3 for reference) stored in the distinctive information storage unit 14 and writes (sets) the level determination table in the working memory (to be described later) (step 204). Thereafter, by using the disaster information acquired, the mode switching unit 13 matches the disaster information to the level determination table (step 205). The disaster level obtained as a result of matching the disaster information to the level determination table is written in (set in) the working memory (step 206). The processing moves to the process for mode switching shown in step 103 in FIG. 4.

Next, a description will be given to the process for mode switching.

Figure 6:
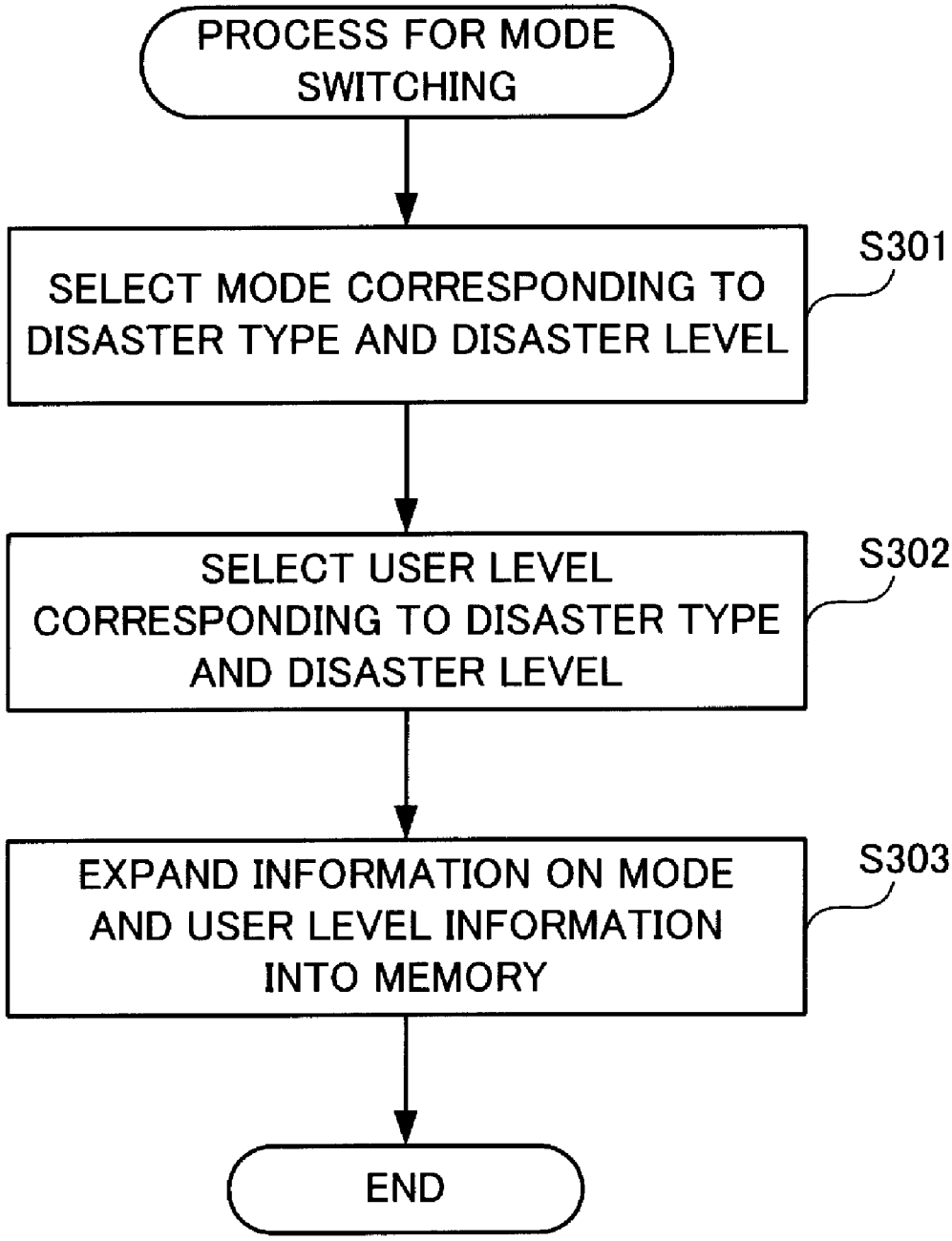
FIG. 6 is a flowchart illustrating in detail the process for mode switching.

FIG. 6 is a flowchart illustrating in detail the process for mode switching shown in step 103 in FIG. 4. The apparatus control unit 17 of the image processing apparatus 10 selects a mode corresponding to the disaster type and the disaster level (step 301). The apparatus control unit 17 also selects a level of authority granted to the user operating the image processing apparatus 10 in the selected mode (step 302). Thereafter, the apparatus control unit 17 expands information on the selected mode (mode information) and information on the level of authority granted to the user (user level information) into the memory (step 303), and the processing is finished.

FIGS. 7A and 7B show examples of memory information (for example, matching tables) for selecting the mode corresponding to the disaster type and the disaster level (disaster stage) that is used in the process of step 301. The matching tables that are the memory information as shown in FIGS. 7A and 7B are stored, for example, in a predetermined memory or the like that is utilized by the apparatus control unit 17. In the predetermined memory, for example, plural matching tables such as FIGS. 7A and 7B are stored. In the matching tables, a type of mode according to the disaster level is shown for each of the disaster types. In the examples of FIGS. 7A and 7B, the mode information and the user level information for each of the disaster levels LV1 to LV3 are shown for each of the disaster types including earthquake, wind and flood, volcano, nuclear power, snow, accident, and others.

In the examples shown in FIGS. 7A and 7B, a "normal mode" shows the operational mode in a normal operational state (first operational mode), a "continuous mode" shows an operational mode (second operational mode) in which the operation is continued, even when there is lack of a part of consumables or failure of a part of functions, by using other consumables that are available and other functions that do not fail. "ULVn" shows that only a user having a user level n may operate the image processing apparatus 10 in the continuous mode, when the continuous mode is selected according to the disaster type and the disaster level. For example, upon receiving an instruction to switch into a mode corresponding to the disaster level LV3 in the earthquake disaster from the mode switching unit 13 when the matching table shown in FIG. 7A is selected, the apparatus control unit 17 refers to the matching table, in which the "continuous mode" and the "ULV2" are indicated at the column corresponding to the disaster level LV3 in the earthquake disaster, shown in FIG. 7A. The apparatus control unit 17 expands information that a current operational mode of the image processing apparatus 10 is the continuous mode and a level of user having authority to instruct the operation in the continuous mode is the user level 2 into the memory.

In addition, selection of a matching table from the plural matching tables as shown in FIGS. 7A and 7B may preferably be performed by recognizing the input of information that is to identify a site such as, for example, address or postal code of site where the image processing apparatus 10 is installed. For example, when the image processing apparatus 10 is installed in an environment where there is no fear for the volcanic disaster and the snow disaster may be almost ignored according to address information inputted, the matching table as shown in FIG. 7B as an example is selected. For example, when the image processing apparatus 10 is installed in an area where there is a warning for the earthquake disaster, the matching table that quickly responds to the earthquake disaster is selected.

Next, a description will be given to a specific operation of the image processing apparatus 10 after the continuous mode is set.

In the present exemplary embodiment, the image processing apparatus 10 determines whether the operational mode is the normal mode or the continuous mode. When it is determined that the mode is the continuous mode, the image processing apparatus 10 performs the image processing, even when there is lack of a part of consumables or failure of a part of functions, by using other consumables that are available and other functions that do not fail. Hereinafter, the exemplary embodiment will be described in detail as three examples.

Example 1

The present example is a process for print output in the case where there is lack of sheets of paper as an example of the consumables. When there is the lack of sheets of paper, an error generally occurs and the operation of the image processing apparatus is stopped. However, in the present example, when the operational mode is the continuous mode, enlargement and reduction, margin setting at the same magnification, divided output and the like are automatically performed.

Figure 8:
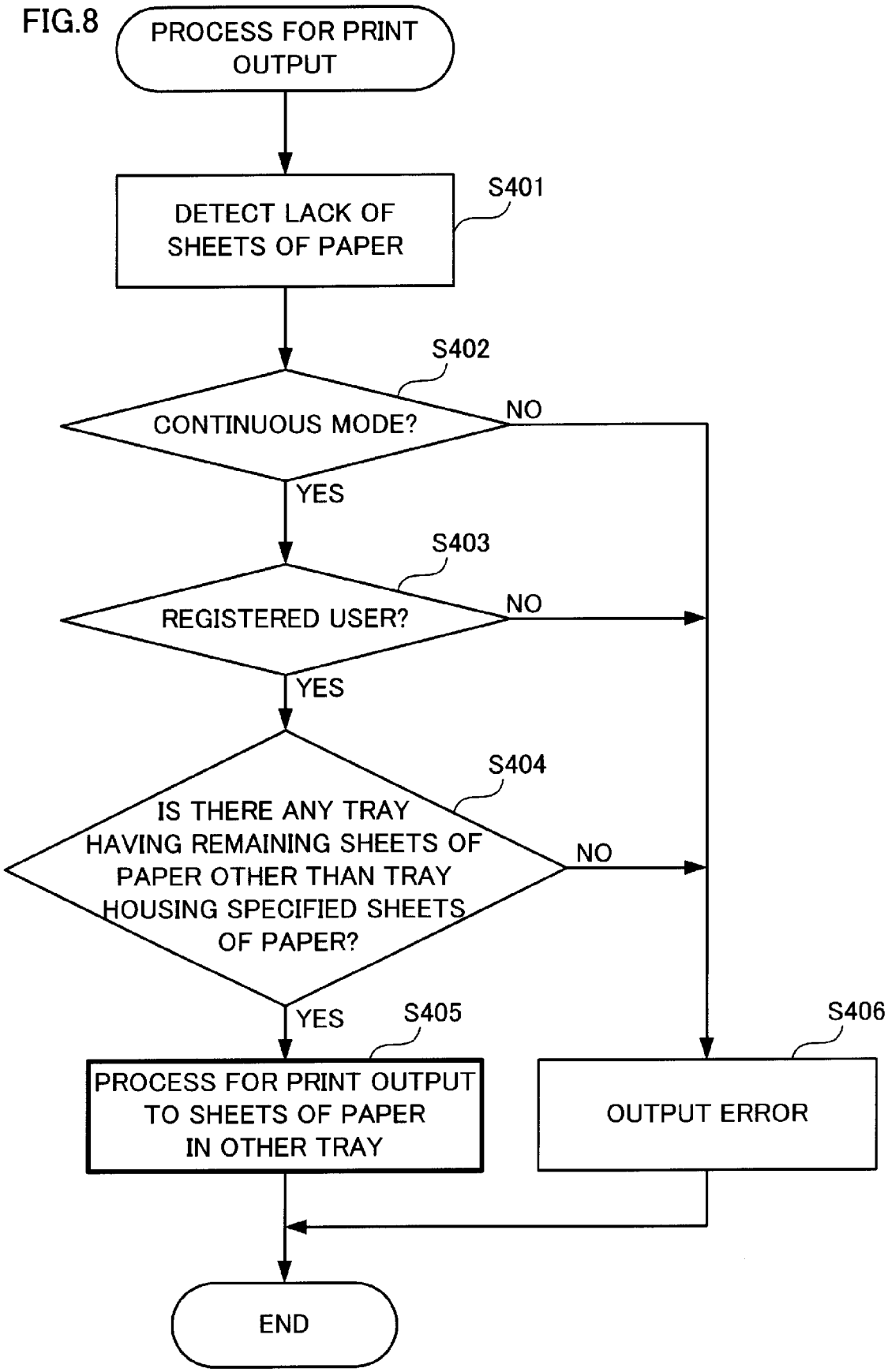
FIG. 8 is a flowchart illustrating an operational example of the process for print output.

FIG. 8 is a flowchart illustrating an operational example of the process for print output. The apparatus control unit 17 of the image processing apparatus 10 receives, for example, information on a remaining amount of sheets of paper from the image forming unit 23. When the remaining amount of sheets of paper with a size specified in a print output instruction is small, the lack of sheets of paper is detected (step 401). The apparatus control unit 17 refers to the mode information expanded into the memory in step 303 in FIG. 6 and determines whether or not the current operational mode of the image processing apparatus 10 is the continuous mode (step 402).

When the mode is the continuous mode, the apparatus control unit 17 refers to the user level information expanded into the memory in step 303 in FIG. 6, and determines whether or not the user who gives the print output instruction is a user who has the user level (registered user) (step 403). When the user is the registered user, the apparatus control unit 17 determines whether or not there is any tray having remaining sheets of paper other than a tray in which sheets of paper with a specified size are housed (step 404: YES). When there is the other tray, the process for print output to the sheets of paper in the other tray is performed (step 405).

When it is determined that the mode is not the continuous mode (that is, the normal mode) in step 402, the error is outputted (step 406) and the processing is finished. When it is determined that the user who gives the print output instruction is not the registered user in step 403, the error is also outputted (step 406) and the processing is finished. When it is determined that there is no other tray having remaining sheets of paper in step 404, the error is also outputted (step 406) and the processing is finished.

Meanwhile, in the flowchart of FIG. 8, even when it is determined that the operational mode is the continuous mode in step 402, unless it is determined that the registered user gives the print output instruction in step 403, the operation in the continuous mode (print output to the sheets of paper in the other tray) is not performed. That is, in the present example, the apparatus control unit 17 has a function as an example of an identifying unit that identifies a user having authority to instruct the operation in the continuous mode. However, the determination in step 403 is not necessarily conducted. When it is determined that the operational mode is the continuous mode in step 402, the operation in the continuous mode may be performed without any conditions. In addition, in this case, there is no need for storing the user level information in the matching table in FIG. 7, and there is no need for expanding the user level information into the memory in step 303 in FIG. 6.

Next, a description will be given to an example of the process for the print output to the sheets of paper in the other tray.

Figure 9:
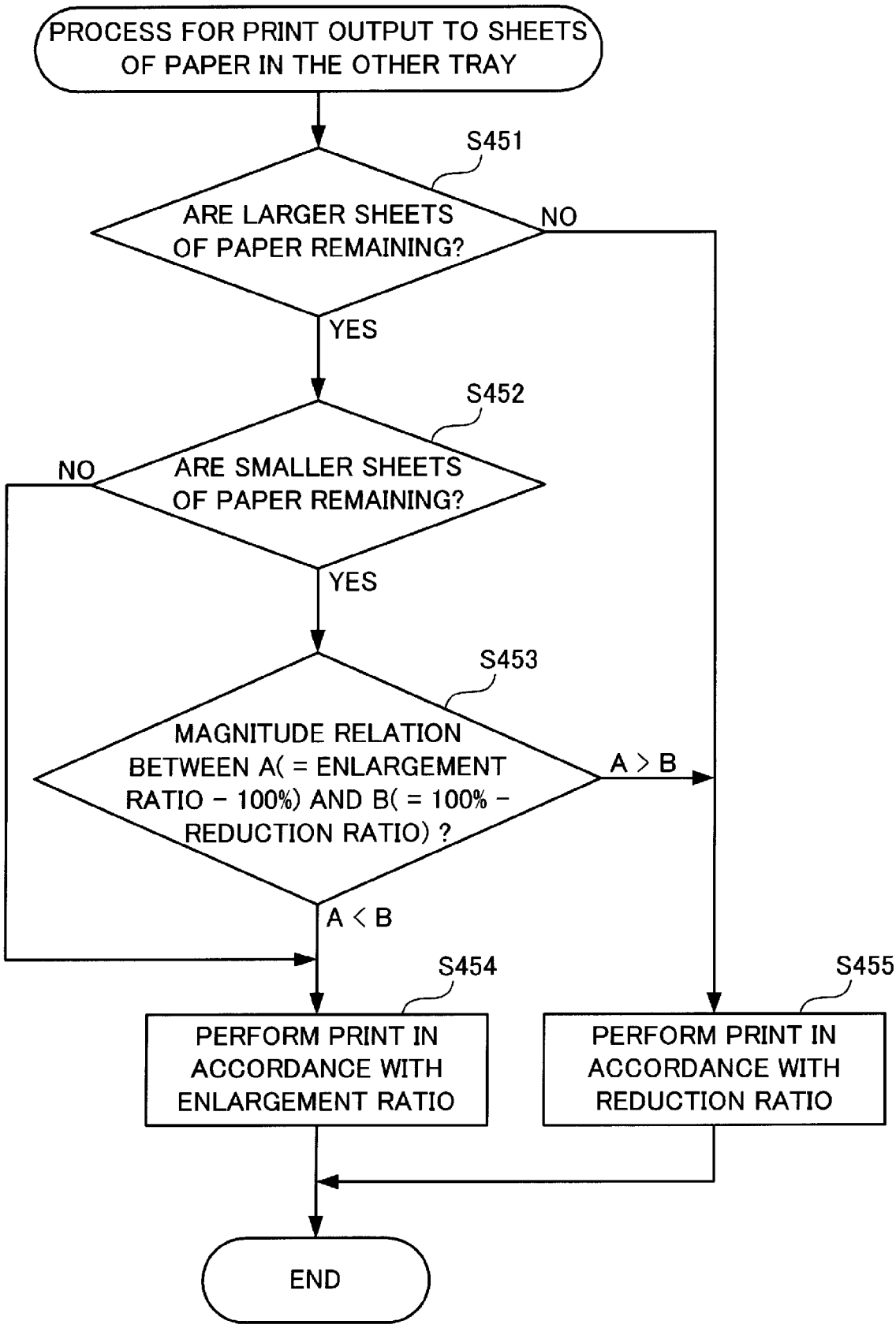
FIG. 9 is a flowchart illustrating in detail the process for print output to the sheets of paper in the other tray.

FIG. 9 is a flowchart illustrating in detail the process for print output to the sheets of paper in the other tray shown in step 405 in FIG. 8. The apparatus control unit 17 of the image processing apparatus 10 determines whether or not sheets of paper whose size is larger than the one specified in a print output instruction remain, on the basis of the information on the remaining amount of the sheets of paper received in step 401 in FIG. 8 (step 451). When the larger sheets of paper are determined to remain in step 401, the apparatus control unit 17 determines whether or not sheets of paper whose size is smaller than the one specified in a print output instruction also remain (step 452). When the smaller sheets of paper are determined to also remain in step 452, an enlargement ratio from the specified size to the larger size is determined and a value A is calculated by subtracting 100% from the enlargement ratio (=enlargement ratio−100%) at first. A reduction ratio from the specified size to the smaller size is determined and a value B is calculated by subtracting the reduction ratio from 100% (=100%−reduction ratio). Thereafter, a magnitude relation between A and B is determined (step 453).

Moreover, when it is determined to be "NO" in step 452 or when it is determined to be "A<B" in step 453, the print in accordance with the enlargement ratio is performed (step 454). In the former case, since there are no sheets of paper whose size is specified and there are the larger sheets of paper whose size is larger than the one specified, enlargement print is outputted. In the latter case, there are no sheets of paper whose size is specified and there are the larger sheets of paper whose size is larger than the one specified and the smaller sheets of paper whose size is smaller than the one specified. In such a case, since the enlargement ratio is nearer from the original size than the reduction ratio, enlargement print is outputted. As the print in accordance with the enlargement ratio, for example, when the enlargement ratio is 141% or more, it may be thought that two pages of images are printed out on a single side of a sheet of paper. When the enlargement ratio is 141% or less, general enlargement print may be performed or the print at the same magnification providing with extra margin may be performed.

Moreover, when it is determined to be "NO" in step 451 or when it is determined to be "A>B" in step 453, the print in accordance with the reduction ratio is performed (step 455). In the former case, since there are no sheets of paper whose size is specified and there are the sheets of paper whose size is smaller than the one specified, reduction print is outputted. In the latter case, there are no sheets of paper whose size is specified and there are the sheets of paper whose size is larger than the one specified and the sheets of paper whose size is smaller than the one specified. In such a case, since the reduction ratio is nearer from the original size than the enlargement ratio, reduction print is outputted. As the print in accordance with the reduction ratio, for example, general reduction print may be performed or printing the image at the same magnification by dividing the image into plural pages may be performed.

Example 2

The present example is the process for print output in the case where there is lack of toner as an example of the consumables. When there is the lack of toner, an error generally occurs and the operation of the image processing apparatus is stopped. However, in the present example, when the operational mode is the continuous mode, the toner is automatically substituted by a toner of other color and the image is outputted. Moreover, although the present example is generally applied to the case where there is lack of color material of the specified color, a description will be given to the case where there is the lack of toner as an example of the color material hereinafter.

Figure 10:
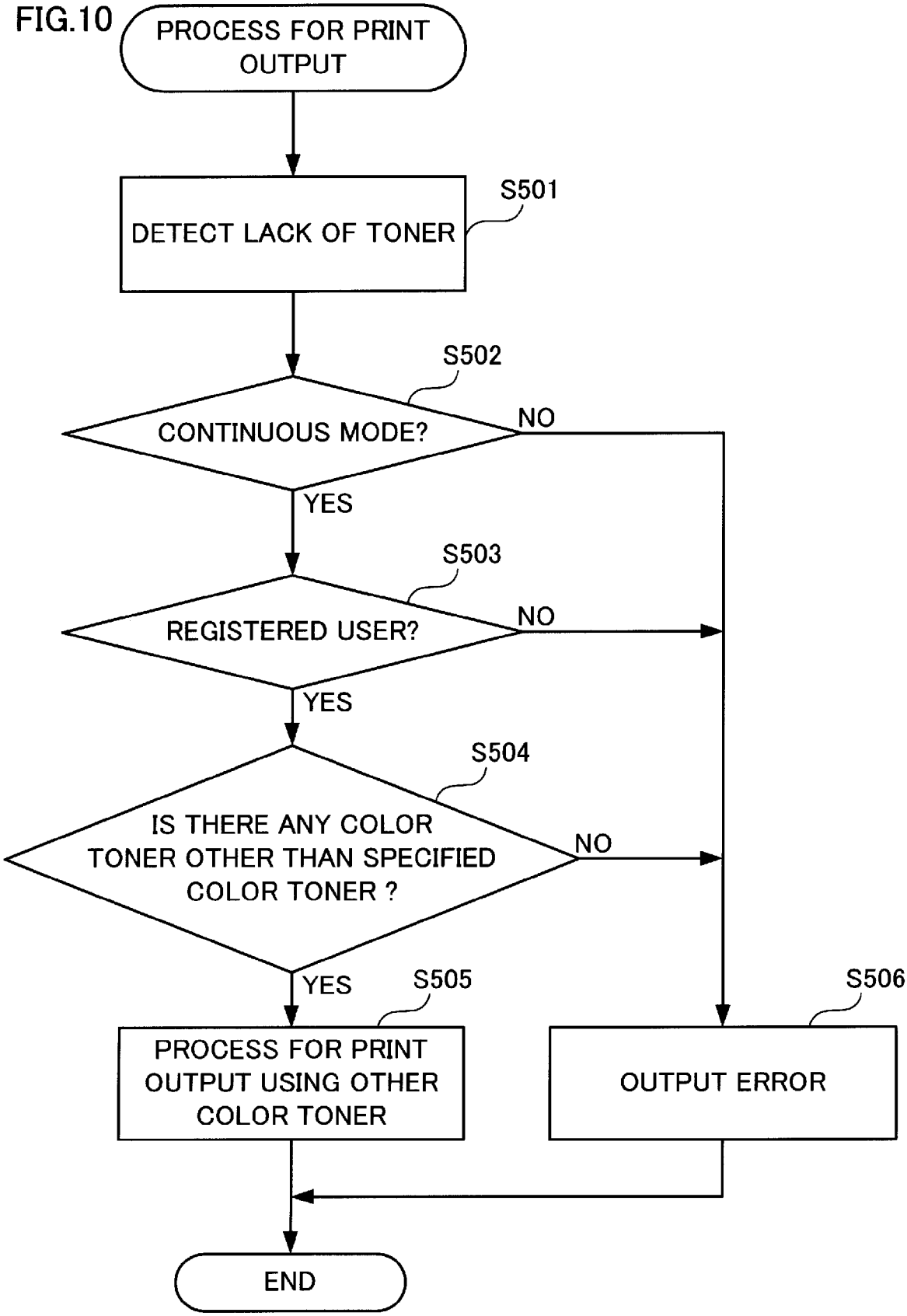
FIG. 10 is a flowchart illustrating an operational example of the process for print output.

FIG. 10 is a flowchart illustrating an operational example of the process for print output. The apparatus control unit 17 of the image processing apparatus 10 receives, for example, information on a remaining amount of toner from the image forming unit 23. When the remaining amount of toner with a color specified in a print output instruction is small, the lack of the toner is detected (step 501). The apparatus control unit 17 refers to the mode information expanded into the memory in step 303 in FIG. 6 and determines whether or not the current operational mode of the image processing apparatus 10 is the continuous mode (step 502).

When the mode is determined to be the continuous mode in step 502, the apparatus control unit 17 refers to the user level information expanded into the memory in step 303 in FIG. 6, and determines whether or not the user who gives the print output instruction is a user who has the user level (registered user) (step 503). When the user is determined to be the registered user in step 503, the apparatus control unit 17 determines whether or not there is any color toner other than the color toner specified (step 504). When there is other color toner, the process for print output using the other color toner is performed (step 505).

When it is determined that the mode is not the continuous mode (that is, the normal mode) in step 502, the error is outputted (step 506) and the processing is finished. When it is determined that the user who gives the print output instruction is not the registered user in step 503, the error is also outputted (step 506) and the processing is finished. When it is determined that there is no other color toner other than the color toner specified in step 504, the error is also outputted (step 506) and the processing is finished.

Meanwhile, in the flowchart of FIG. 10, even when it is determined that the operational mode is the continuous mode in step 502, unless it is determined that the registered user gives the print output instruction in step 503, the operation in the continuous mode (print output using any other color toner) is not performed. That is, in the present example, the apparatus control unit 17 has a function as an example of an identifying unit that identifies a user having authority to instruct the operation in the continuous mode. However, the determination in step 503 is not necessarily conducted. When it is determined that the operational mode is the continuous mode, the operation in the continuous mode may be performed without any conditions. In addition, in this case, there is no need for storing the user level information in the matching table in FIG. 7, and there is no need for expanding the user level information into the memory in step 303 in FIG. 6.

Next, a description will be given to an example of the process for print output by using a toner of other color.

FIG. 11 is a table that is referred to in the process for print output by the toner of other color shown in step 505 in FIG. 10. The apparatus control unit 17 of the image processing apparatus 10 refers to the table in FIG. 11 on the basis of the information on the remaining amount of the toner received in step 501 and step 504 in FIG. 10. That is, in combinations of "toner remaining" and "no toner" defined to each of black, cyan, magenta, and yellow toners, a line including a combination corresponding to a combination of "toner remaining" and "no toner" acquired in step 501 and step 504 is identified. Then the information of "toner to be used" defined in the line is taken out. By using one or more toners corresponding to the information taken out, the print output is performed.

For example, assume a case that "no toner" is detected for black toner in Step 501, and "toner remaining" is detected for all of cyan toner, magenta toner and yellow toner in Step 504.

In this case, by referring to a column of "toner to be used", it is determined that the image forming is performed by using a black color made from mix of cyan toner, magenta toner and yellow toner (process black).

Further, assume a case that "no toner" is detected for black toner in Step 501, "no toner" is detected for yellow toner in step 504, and "toner remaining" is detected for cyan toner and magenta toner in step 504. In this case, by referring to the column of "toner to be used", it is determined that the image forming is performed by using a blue color made from mix of cyan toner and magenta toner.

Furthermore, assume a case that "no toner" is detected for black toner in Step 501, "no toner" is detected for cyan toner and magenta toner in step 504, and "toner remaining" is detected for yellow toner in step 504. In this case, by referring to the column of "toner to be used", it is determined in step 504 that the image forming is not performed. This is because it is considered that it is difficult to form a readable image only with the yellow toner.

Besides, FIG. 11 shows an "output color" in the case where one or more toners defined as the "toner to be used" are used, the "output color" is just for reference and does not have to be stored in the table.

Example 3

The present example is a process for scanning in the case where there is failure (breakdown and the like) in a function other than the scanner. When an error occurs such as opening of a front door or paper jam at receiving a request of scanner use, an error generally causes the operation of the image processing apparatus to stop. However, in the present example, when the operational mode is the continuous mode, it is determined in step 603 (later described) whether or not the error influences the use of scanner. If the error does not influence the use of scanner, the use of scanner is permitted despite the error.

Figure 12:
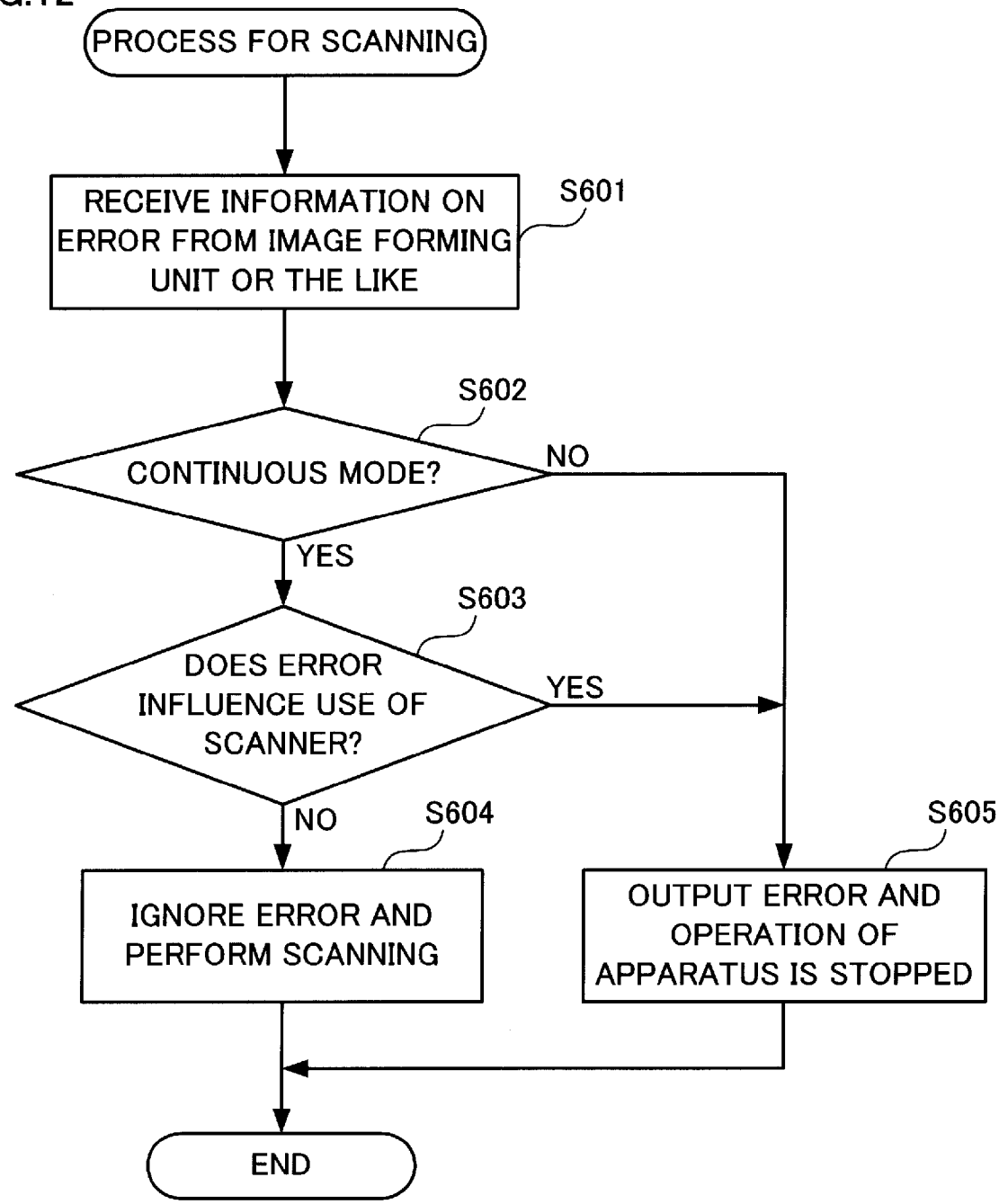
FIG. 12 is a flowchart illustrating an operational example of the process for scanning.

FIG. 12 is a flowchart illustrating an operational example of the process for scanning. The apparatus control unit 17 of the image processing apparatus 10 receives, for example, information on error from the image forming unit 23 (step 601). Then the apparatus control unit 17 refers to the mode information expanded into the memory in step 303 in FIG. 6, and determines whether or not the current operational mode of the image processing apparatus 10 is the continuous mode (step 602).

If it is determined to be in the continuous mode in step 602, the apparatus control unit 17 refers to the influence determination table regarding scanner use shown in FIG. 13 and determines whether or not the error influences the use of scanner (step 603). Here, a description will be given to the influence determination table regarding scanner use in FIG. 13. The table is formed by information on error types and on whether or not errors influence the use of scanner. For example, the influence determination table defines that CRU (customer replaceable unit) non-mounting error, door open error, paper jam, and fixing unit error do not influence the use of scanner, while a scanner motor error and a hard disc error influence the use of scanner.

When it is determined in step 603 that the error does not influence the use of scanner, the scanning is performed ignoring the error (step 604).

When it is determined that the operational mode is not the continuous mode (that is, the normal mode) in step 602, the error is outputted (step 605) and the operation of the image processing apparatus 10 is stopped. When it is determined that the error influences the scanning in step 603, the error is also outputted (step 605) and the operation of the image processing apparatus 10 is stopped.

In the present example, when it is determined that the operational mode is the continuous mode in step 602, it is only determined whether or not the error influences the use of scanner in step 603, and it is not determined whether or not the user is the registered user who has authority to give the instruction for the operation in the continuous mode (scanning ignoring the error) unlike the first and second examples. However, such determination may be conducted in the present example. That is, the apparatus control unit 17 may have a function as an example of the identifying unit that identifies the user having authority to instruct the operation in the continuous mode.

Meanwhile, in the time of disaster or the like, as a supply source of electric power to the image processing apparatus 10, not the main power source such as home power source but the secondary power source such as a generator is used in some cases. In this case, since it is necessary to save the electric power, a predetermined mode (for example, a mode for realizing the maximum power saving) among power saving modes (modes for economizing power) installed in the machine is forcibly set. Hereinafter, a description will be given to a process for setting the power saving mode at the time of turning the power source on or turning the power source off in the case where the continuous mode is set, as a fourth example. Moreover, the "secondary power source" described here may be inside or outside of the image processing apparatus 10. When the secondary power source is outside of the image processing apparatus 10, the secondary power source may be particularly called as an "outside power source".

Example 4

Figure 14:
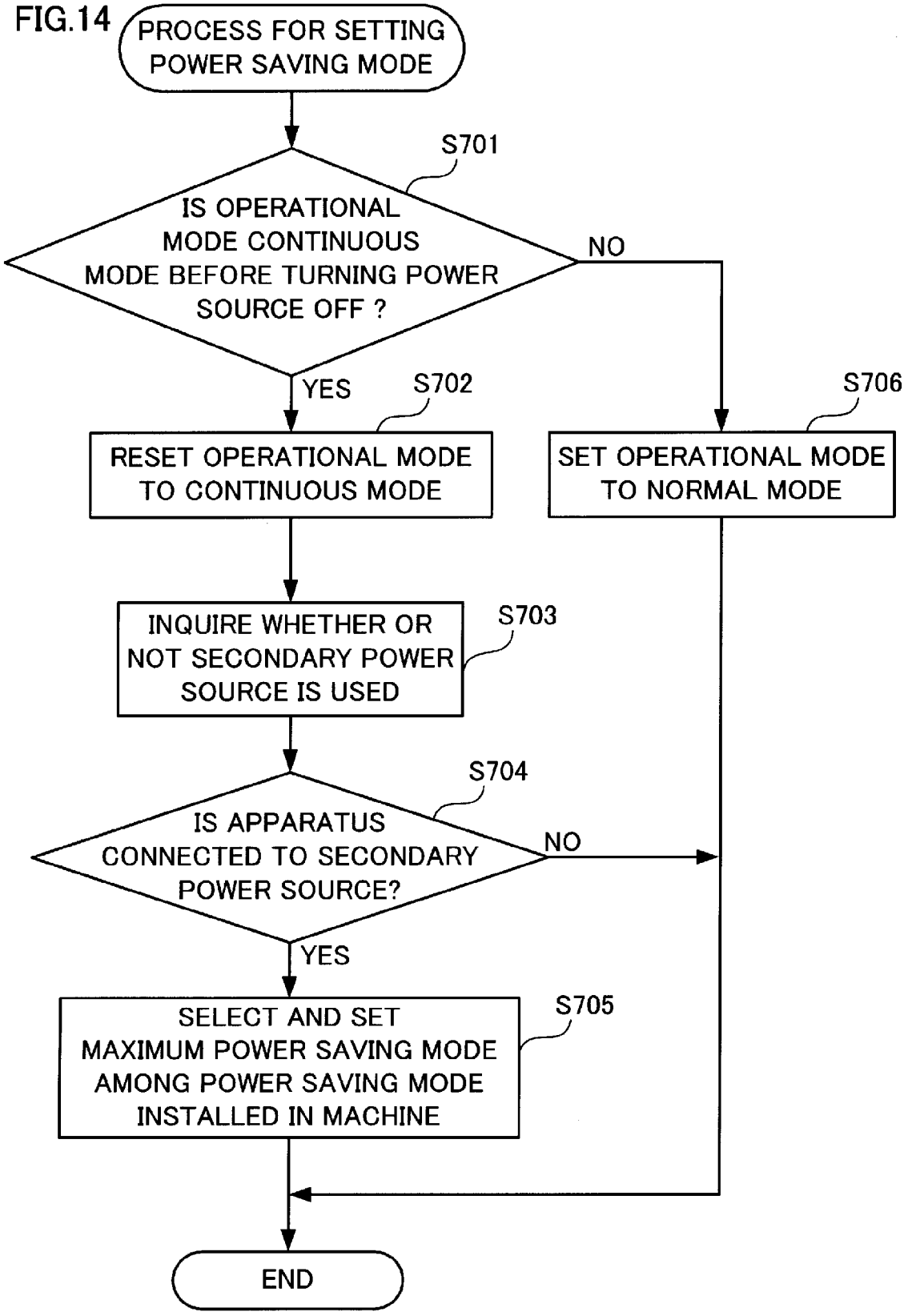
FIG. 14 is a flowchart illustrating an operational example of the process for setting the power saving mode.

FIG. 14 is a flowchart illustrating an operational example of the process for setting the power saving mode. As described above, the apparatus control unit 17 of the image processing apparatus 10 expands the mode information into the memory that the apparatus control unit 17 uses, and refers to the mode information. When the turning-off of the power source is instructed, the apparatus control unit 17 backs up the mode information as an example of the information on the switching of the operational mode of the image processing apparatus 10, for example, to a magnetic disc or the like.

Thereafter, when the turning-on of the power source is instructed, the apparatus control unit 17 refers to the backed-up mode information and determines whether or not the operational mode is the continuous mode before turning the power source off (step 701). When the operational mode is determined to be the continuous mode before turning the power source off in step 701, the apparatus control unit 17 resets the operational mode of the image processing apparatus 10 to the continuous mode (step 702). When the operational mode is determined not to be the continuous mode before turning the power source off, the apparatus control unit 17 sets the operational mode of the image processing apparatus 10 to the normal mode instead of the continuous mode (step 706).

When the operational mode is determined to be the continuous mode before turning the power source off in step 701, the apparatus control unit 17 inquires whether or not the image processing apparatus 10 uses the secondary power source as the supply source of electric power after resetting to the continuous mode (step 703). The secondary power source is an example of the supply source of electric power used in the time of disaster instead of the main power source that is the supply source of power in a normal operation state. The inquiry in step 703 regarding whether or not the image processing apparatus 10 is connected to the secondary power source may be answered by, for example, a user operating the UI unit 15.

In response to input of the user as an answer to the inquiry, the apparatus control unit 17 determines whether or not the image processing apparatus 10 is connected to the secondary power source (step 704). When it is determined in step 704 that the image processing apparatus 10 is connected to the secondary power source, the apparatus control unit 17 sets the image processing apparatus 10 to the maximum power saving mode among the power saving modes installed in the machine (step 705). When it is determined in step 704 that the image processing apparatus 10 is not connected to the secondary power source, the apparatus control unit 17 does not set the image processing apparatus 10 to the power saving mode.

Moreover, in the present example, as an example of the memory that stores the information on switching of the operational mode of the image processing apparatus 10, an area of the magnetic disc or the like to which the mode information is backed up is adopted. In addition, the apparatus control unit 17 has a function as an example of a setting unit that sets the operational mode of the image processing apparatus 10 to the second operational mode, if the information on switching stored in the memory shows that the first operational mode has been switched to the second operational mode when a power source of the image processing apparatus 10 is turned on after being turned off. Further, in the present example, the apparatus control unit 17 is provided as an example of a configuration including a determination unit that determines whether or not the secondary power source that is a supply source in the time of disaster is used as a supply source of electric power for image processing instead of the main power source that is a supply source in a normal operation state, and a setting unit that sets such that when it is determined that the secondary power source is used, power consumption of the image processing apparatus 10 is less than the one in the case of using the main power source.

Finally, a description will be given to a hardware configuration on a part having a function as a computer in the image processing apparatus 10.

Figure 15:
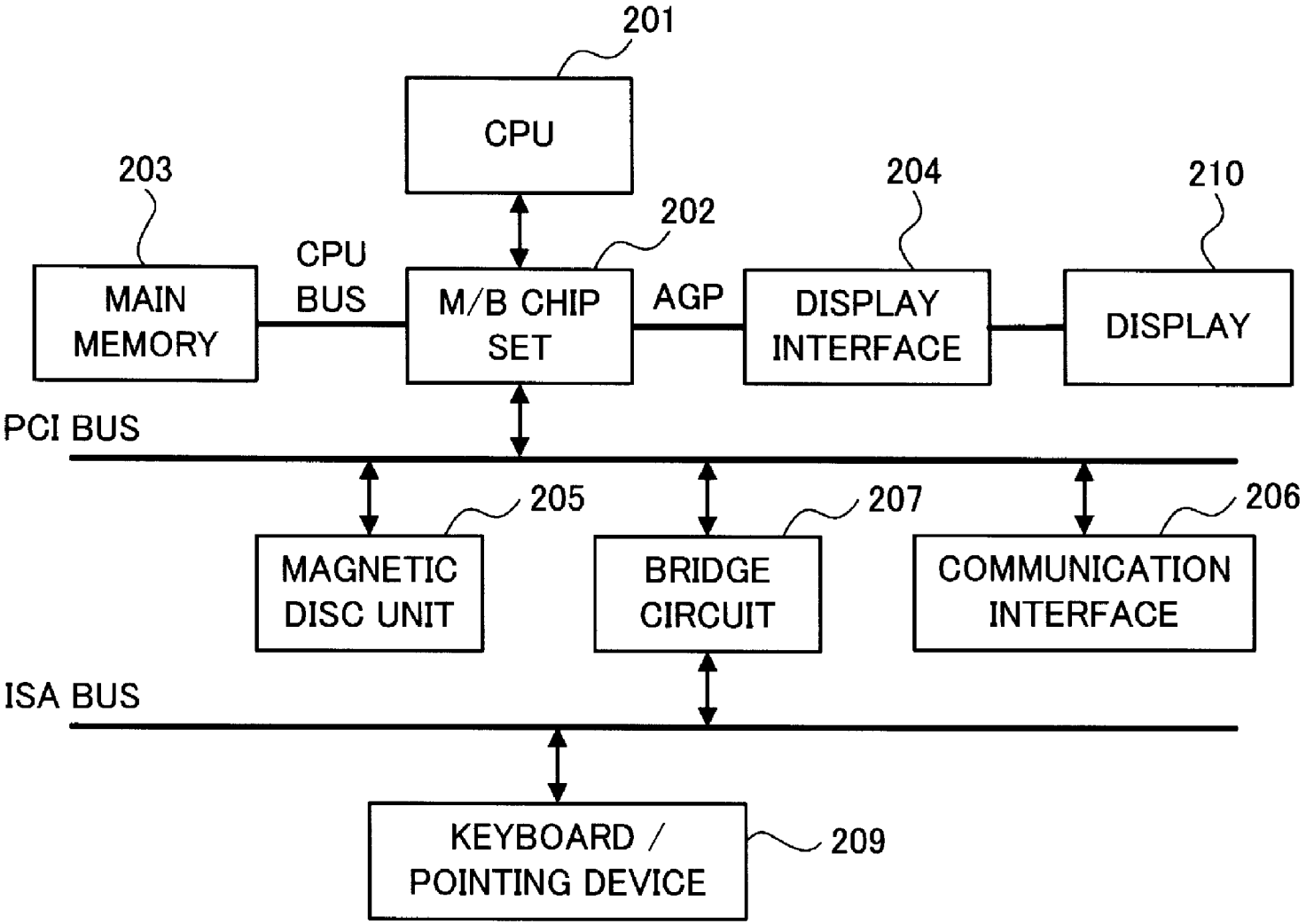
FIG. 15 is a diagram illustrating the hardware configuration on the part having a function, for example, as the computer in the image processing apparatus.

FIG. 15 is a diagram illustrating the hardware configuration on the part having a function, for example, as the computer in the image processing apparatus 10. The computer shown in FIG. 15 is provided with a CPU (Central Processing Unit) 201 that is a computing unit, a motherboard (M/B) chip set 202 and a main memory 203 that is connected to the CPU 201 through a CPU bus. Moreover, through the M/B chip set 202, for example, a display interface 204 such as a video card and a display 210 are connected to the CPU 201. Further, the computer is provided with a magnetic disc unit (HDD: Hard Disk Drive) 205 and a communication interface 206 that are connected to the M/B chip set 202, for example, through a PCI (Peripheral Component Interconnect) bus or the like. Furthermore, the computer is provided with a keyboard/pointing device 209 that is connected to the M/B chip set 202 through the PCI bus, a bridge circuit 207, and a low speed bus such as an ISA (Industry Standard Architecture) bus.

Here, the CPU 201 executes various kinds of software such as OS (Operating System) and applications, and realizes the various functions described above. In addition, the main memory 203 has a function as the working memory having a memory area that stores the various kinds of software and data to be used for executing the software and the like. Further, the magnetic disc unit 205 is a memory provided with a memory area that stores input data to the various kinds of software, output data from the various kinds of software or the like. In the present exemplary embodiment, the magnetic disc unit 205 also has a function as the distinctive information storage unit 14. Moreover, there is a case in which instead of the magnetic disc unit 205, a semiconductor memory represented by a flash memory or the like is used. In addition, in the present exemplary embodiment, the UI unit 15 is provided with the display 210 and the keyboard/pointing device 209 as a UI. Further, the external IF 11 is realized by using the hardware of the communication interface 206.

As described above, the various processes shown in the present exemplary embodiment are realized through application programs executed by the CPU 201, with the main memory 203 that is the working memory. The application programs may be provided in a state in which the application programs are installed in the image processing apparatus 10 when the image processing apparatus 10 as a computer is provided to a customer (including the user). The application programs may also be provided by a computer readable medium, which stores the programs to be executed by the computer in a state that the computer can read the programs. A CD-ROM medium or the like is an example of the memory medium. A CD-ROM reading device (not shown) or the like reads and executes the programs. The programs may be provided, for example, through a communication unit such as the network by a program transmission apparatus (not shown) and through the communication interface 206 such as a network interface. The program transmission apparatus is provided with, for example, a memory that stores the programs provided in a server computer on the host computer side or the like, and a program transmission unit that provides the programs through the network.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image processing apparatus comprising:

an acquiring unit that acquires information on a disaster; and a switching unit that switches an operational mode of the image processing apparatus from a first operational mode, in which image processing is not performed when there is lack of a part of consumables or failure of a part of functions, to a second operational mode, in which the image processing is performed by using other consumables that are available and other functions that do not fail even when there is the lack of a part of consumables or the failure of a part of functions, in response to the information on the disaster acquired by the acquiring unit, wherein the disaster is at least one of a fire disaster, a natural disaster, a terrorist attack, and a nuclear power disaster.

2. The image processing apparatus according to claim 1, wherein the switching unit switches the operational mode of the image processing apparatus from the first operational mode, in which the image processing is not performed when there is a lack of sheets of paper with a specified size, to the second operational mode, in which the image processing is performed by using sheets of paper with a size other than the specified size when there is the lack of sheets of paper with the specified size.

3. The image processing apparatus according to claim 1, wherein the switching unit switches the operational mode of the image processing apparatus from the first operational mode, in which the image processing is not performed when there is lack of color material of a specified color, to the second operational mode, in which the image processing is performed by using color material of a color other than the specified color when there is the lack of color material of the specified color.

4. The image processing apparatus according to claim 1, further comprising an image reading part that reads an image, wherein the switching unit switches the operational mode of the image processing apparatus from the first operational mode, in which the image reading part does not read the image when there is the failure of a part of functions, to the second operational mode, in which the image reading part reads the image when there is the failure of a part of functions, if the failure does not influence reading of an image by the image reading part.

5. The image processing apparatus according to claim 1, further comprising an identifying unit that identifies a user having authority to instruct the image processing in the second operational mode.

6. The image processing apparatus according to claim 1, further comprising:

a memory that stores information on switching of the operational mode of the image processing apparatus by the switching unit; and a setting unit that sets the operational mode of the image processing apparatus to the second operational mode if the information on switching stored in the memory shows that the first operational mode is switched to the second operational mode when a power source of the image processing apparatus is turned on after turned off.

7. An image processing apparatus comprising:

a determination unit that determines whether an operational mode of the image processing apparatus is a normal operational mode or a disaster operational mode; and an image processing unit that performs image processing by using other consumables that are available and other functions that do not fail even when there is lack of a part of consumables or failure of a part of functions when the determination unit determines that the operational mode of the image processing apparatus is the disaster operational mode, wherein the disaster is at least one of a tire disaster, a natural disaster, a terrorist attack, and a nuclear power disaster.

8. An image processing method comprising:

determining whether an operational mode of an image processing apparatus is a normal operational mode or a disaster operational mode; and performing image processing by using other consumables that are available and other functions that do not fail even when there is lack of a part of consumables or failure of a part of functions when the operational mode of the image processing apparatus is determined to be the disaster operational mode, wherein the disaster is at least one of a tire disaster, a natural disaster, a terrorist attack, and a nuclear power disaster.

9. A computer readable medium storing a program causing a computer to execute a process for image processing, the process comprising:

acquiring information on a disaster; and switching an operational mode of an image processing apparatus from a first operational mode, in which image processing is not performed when there is lack of a part of consumables or failure of a part of functions, to a second operational mode, in which the image processing is performed by using other consumables that are available and other functions that do not fail even when there is the lack of a part of consumables or the failure of a part of functions, in response to the acquired information on the disaster, wherein the disaster is at least one of a tire disaster, a natural disaster, a terrorist attack, and a nuclear power disaster.

10. The computer readable medium according to claim 9, wherein the process for switching is to switch the operational mode of the image processing apparatus from the first operational mode, in which the image processing is not performed when there is lack of sheets of paper with a specified size, to the second operational mode, in which the image processing is performed by using sheets of paper with a size other than the specified size when there is the lack of sheets of paper with the specified size.

11. The computer readable medium according to claim 9, wherein the process for switching is to switch the operational mode of the image processing apparatus from the first operational mode, in which the image processing is not performed when there is lack of color material of a specified color, to the second operational mode, in which the image processing is performed by using color material of a color other than the specified color when there is the lack of the color material of the specified color.

12. The computer readable medium according to claim 9, wherein the process for switching is to switch the operational mode of the image processing apparatus from the first operational mode, in which an image reading part of the image processing apparatus does not read an image when there is the failure of a part of functions, to the second operational mode, in which the image reading part reads the image when there is the failure of a part of functions if the failure does not influence reading of an image by the image reading part.

13. The computer readable medium according to claim 9, the process further comprising: identifying a user having authority to instruct the image processing in the second operational mode.

14. The computer readable medium according to claim 9, wherein the process further comprises:

storing information on switching of the operational mode of the image processing apparatus by the process for switching, in a memory of the image processing apparatus; and setting the operational mode of the image processing apparatus to the second operational mode, if the information on switching stored in the memory shows that the first operational mode is switched to the second operational mode when a power source of the image processing apparatus is turned on after turned off.

15. The image processing apparatus according to claim 1, wherein the disaster comprises an event that occurs external to the image processing apparatus.

* * * * *